US010266295B1

(12) United States Patent
Kelly

(10) Patent No.: US 10,266,295 B1
(45) Date of Patent: Apr. 23, 2019

(54) BLISTER PACK OPENER DEVICE AND METHOD

(71) Applicant: Edmund F Kelly, Costa Mesa, CA (US)

(72) Inventor: Edmund F Kelly, Costa Mesa, CA (US)

( * ) Notice: Subject to any disclaimer, the term of this patent is extended or adjusted under 35 U.S.C. 154(b) by 0 days.

(21) Appl. No.: 15/004,964

(22) Filed: Jan. 24, 2016

Related U.S. Application Data

(63) Continuation of application No. 13/422,178, filed on Mar. 16, 2012, now abandoned.

(51) Int. Cl.
*B26B 3/00* (2006.01)
*B65B 69/00* (2006.01)

(52) U.S. Cl.
CPC ..... *B65B 69/0066* (2013.01)

(58) Field of Classification Search
CPC ..... A61J 1/035; A61J 7/0076; B26B 5/00; B26B 5/001; B26B 27/007
USPC ..... 30/116, 117, 140; 53/457, 492; 81/3.29; 206/532; 219/229, 230, 234, 242; 221/25
See application file for complete search history.

(56) References Cited

U.S. PATENT DOCUMENTS 2,896,059 A * 7/1959 Ruff ..... B29D 30/68 219/233
3,491,651 A * 1/1970 Pascoe ..... B26F 3/06 219/233
3,526,750 A * 9/1970 Siegel ..... B23K 3/0315 219/230
3,886,944 A * 6/1975 Jamshidi ..... A61B 18/082 219/233
4,000,395 A * 12/1976 Fischer ..... B26D 3/006 219/221
4,089,336 A * 5/1978 Cage ..... A61B 18/08 219/233
4,367,396 A * 1/1983 Ravinsky ..... B23K 3/025 219/231
4,568,819 A * 2/1986 Stacconi ..... B23K 3/0361 219/227
7,284,661 B1 * 10/2007 Evans ..... B65D 83/0463 206/532
2005/0139605 A1 * 6/2005 Benktzon ..... B65D 83/0463 221/25
2005/0210682 A1 * 9/2005 Bartholin ..... B26B 5/001 30/162
2008/0083309 A1 * 4/2008 Lothian ..... B26B 3/00 83/15
2010/0137856 A1 * 6/2010 Burdio Pinilla ..... A61B 18/148 606/33

* cited by examiner

*Primary Examiner* — Andrew M Tecco
*Assistant Examiner* — Eyamindae C Jallow
(74) *Attorney, Agent, or Firm* — Jeffer Mangels; Butler & Mitchell LLP; Brennan C. Swain, Esq.

(57) ABSTRACT

A device is provided for removing product items contained in a blister package having raised protrusions containing the product items and a protective membrane holding the items in the protrusions having a holder. The holder has a first and second end. The device has a first and second heating band post, at least one heating band, a power element, a power switch for supplying a power source to the power element, and electronic control circuitry for controlling current to the heating band.

10 Claims, 3 Drawing Sheets

BLISTER PACK OPENER DEVICE AND METHOD

RELATED APPLICATIONS

The resent application is a Continuation of U.S. Ser. No. 13/422,178 filed on Mar. 16, 2012 and incorporated by reference as if fully rewritten herein.

BACKGROUND OF THE INVENTION

1. Technical Field of the Invention

The present invention relates generally to a device for opening packages, and, more particularly, to a device for opening a blister package.

2. Description of the Background Art

It is well known to use blister packs, among other things, for housing pharmaceutical pills, liquids and other product items. Typically, blister packs consist of a series of blisters formed into a sheet of substantially impermeable clear plastic. The open end of the blister is generally covered with a thin metal foil or peel-off film that may be punctured or removed to access the product items contained within the blister package.

Although blister packages work well with housing the pharmaceutical pills, liquids and other product items, there are many problems associated with blister packages. For example, due to the nature of the contents of the blister packages, it is necessary to attempt to make the blister packages childproof. In order to create a blister package that is childproof, a protective layer is usually added over the foil portion of the blister package in order to prevent the product items from being removed from the blister package before a user intends to remove the product items. The protective layer is usually removed by a user utilizing his fingernail to peel the protective layer from the blister package or breaking off a removable piece of the blister package and then peeling off the layer. Alternatively, blister packages may utilize a protective layer that includes a perforation within the protective layer designed to facilitate the tearing of the protective layer. The blister package designs mentioned above can be very difficult to open by hand and attempts to open the blister packages can result in the blister packages having sharp or jagged edges creating dangerous situations for the users attempting to retrieve the product items.

Another problem associated with the use of blister packages, which runs counter to the childproof necessity, involves the particular type of user who requires the product items held within the blister packages. Specifically, those with limited manual dexterity have a reduced ability to open the blister packages in order to retrieve necessary product items. Besides having to peel off the protective layer, the user is usually required to push the product items through the foil or protective membrane on the backside of the blister package. This can cause the product items to be damaged, sometimes severely, because the substantial amount of force required to push the product items through the membrane is applied directly on the product items thus creating the potential for damages. Because a substantial amount of force is necessary to push the product items through the membrane, a substantial amount of manual dexterity is required. Lastly, this process has the potential of creating unwanted debris, which can contaminate the product items because the amount of force necessary to push the product items through the membrane. When a user attempts to push the product items through the membrane, there is a chance that particles of the membrane or protective cover can dissociate from the cover and attach to the product items, which can be harmful to the user or can potentially decrease the overall effectiveness of the product items.

Another process utilized to open blister packages involves cutting or slicing the protrusion or blister of the blister package. As does pushing the product items through the membrane, cutting or slicing the blister pack also requires a substantial amount of manual dexterity. As stated above with the push through process, the cutting or slicing of the blister package also has the potential of creating unwanted debris. For example, shavings or particles of plastic, foil, or protective membrane of the blister packages created during the cutting or slicing process can become entangled or attached to the product items, which can have adverse effects on the user or have the potential of decreasing the overall effectiveness of the product items. Another problem associated with cutting or slicing blister packages includes the dulling of the blade used for cutting or slicing. The blade of the cutter or slicer usually becomes dull which renders the cutter or slicer inoperable for its intended use as well as creates excessive shavings or particles during the cutting or slicing process.

A further issue that may form an impediment to solving such problem results from the materials used in forming such blister pack packaging. The thermoplastic component is generally formed of polyvinyl chloride (PVC), polychlorotrifluoroethylene (PCTFE) or cyclic olefin copolymers (COC) or polymers (COP) in multilayered combinations with polypropylene (PP), polyethylene (PE) or glycol-modified polyethylene therephthalate (PETg). With the use of such various materials, care must be taking when exposing to heat since outgassing or offgassing of hazardous volatize may result from the degradation or combustion of such materials.

A search of the prior art did not disclose any patents that read directly on the claims of the instant invention; however, the following references were considered related.

U.S. Pat. No. 7,866,049 to Brawner, discloses a hand tool for removing individual items contained in a blister package having a cutting blade having a piercing tip and slicing arms that extend outwardly from opposite sides of the piercing tip.

U.S. Patent Application Pub. No. 2008/0047235 to Greenberg discloses a knife with a handle having a blade which has opposite first and second sides. The device is intended for use in opening thermoformed plastic packaging.

U.S. Patent Application Pub. No. 2005/0210682 to Bartholin discloses a blister pack opening knife which disposes a blade like wire for cutting foil. There is no heating element of the wire blade.

U.S. Patent Application Pub. No. 2008/0083309 to Lothian discloses a tool for opening plaster packs that includes a heating element that forms a blade-like tip that reaches temperatures above 480°, preferably at least 800° F. The heating element is linearly aligned with the axial centerline of the handle.

While a common approach is used to open a blister package or the like, other elements are different enough as to make the combination distinguished over the referenced prior art.

Consequently, a need has been felt for providing an apparatus and method of opening a blister package or the like in an easy, safe and efficient manner.

SUMMARY OF THE INVENTION

It is an object of the present invention to provide an apparatus and method for opening a blister package in an easy, safe and efficient manner in order to remove various objects held within the blister packages.

It is a feature of the present invention to achieve this object by using an apparatus and method for opening blister packages that incorporates a power element and heating band for removing product items from a blister package which requires minimal manual dexterity effort, does not create harmful waste, and does not substantially lose its effectiveness due to use over a significant period of time.

Briefly described according to one embodiment of the present invention, a device is provided for removing product items contained in a blister package having raised protrusions containing the product items and a protective membrane holding the items in the protrusions having a holder. The holder has a first and second end. The device has a first and second heating band post, at least one heating band, a power element, and a power switch for supplying a power source to the power element.

BRIEF DESCRIPTION OF THE DRAWINGS

Advantages and features of the present invention are better understood with reference to the following and more detailed description and claims taken in conjunction with accompanying drawings, in which like elements are identified with like symbols:

DESCRIPTION OF THE PREFERRED EMBODIMENTS

The best mode for carrying out the invention is presented in terms of its preferred embodiment, herein depicted within the Figures:

1. Detailed Description of the Figures

Figure 1:
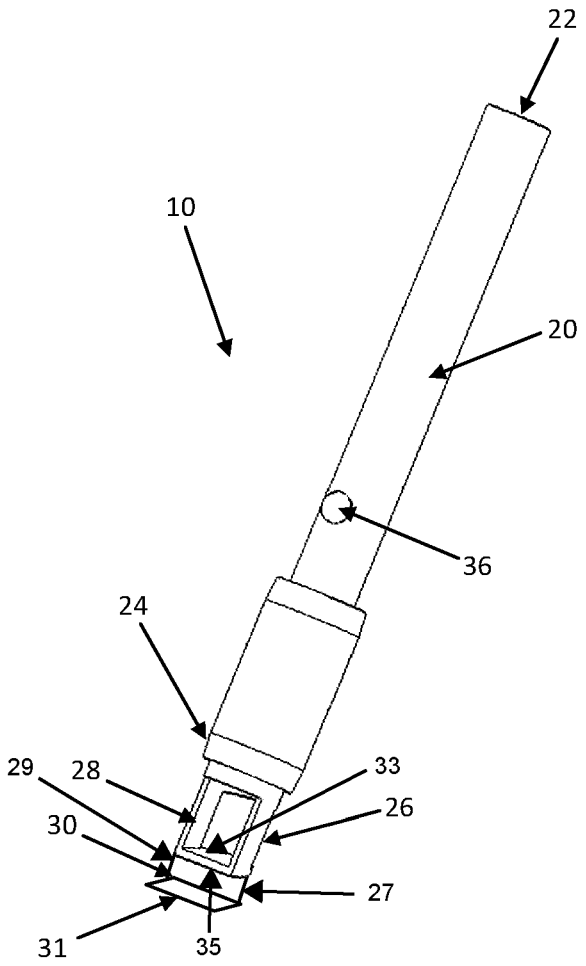
FIG. 1 is a perspective view of a device for removing product items contained in a blister package having raised protrusions containing said product items and a protective membrane holding said items in said protrusions according to the preferred embodiment of the present invention.
Figure 2:
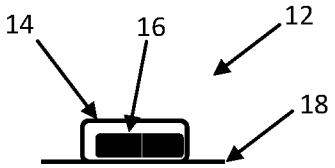
FIG. 2 is a side elevational view of an example of a blister packaging having raised protrusions and a membrane containing a product item according to the PRIOR ART.
Figure 3:
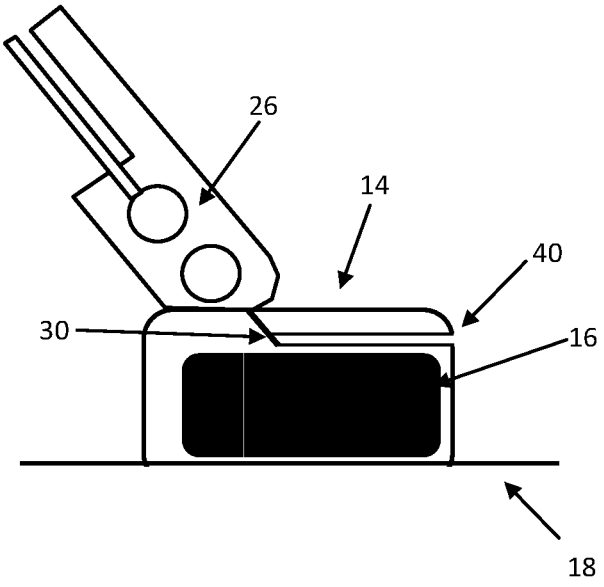
FIG. 3 is a side elevational view of the device according to a preferred embodiment of the present operation in operation.

As shown in conjunction with FIG. 1 through FIG. 3, the present invention provides a unique device, generally noted as 10, for removing product items 16 contained in a blister package 12 having raised protrusions 14 containing said product items 16 and of the type having a protective membrane 18 holding said items 16 in said protrusions 14. A method of using the device 10 further allows for improved removal of product items 16 from blister packages 12. This is achieved using a device 10 having a handle or holder 20 having a first end 22 and a second end 24 for holding the device 10. The device 10 has a first heating band post 26 and a second heating band post 28. The device has at least one heating band 30 extending between and affixed to the first and second heating band posts 26, 28. The first and second heating band posts 26, 28 are vertically disposed relative to the second end 24 and are formed as generally thin and parallel disposed wire like bands. The device also includes a first extension member 27, a second extension member 29, a ledge 33 and a positioning surface 35. The ledge 33 extends between the first and second heating band posts 26, 28 and the positioning surface 35 is the bottom surface of the ledge 33. The device 10 has one power switch 36 for providing a modulated heating of the heating band 30, as described in greater detail below.

Figure 4:
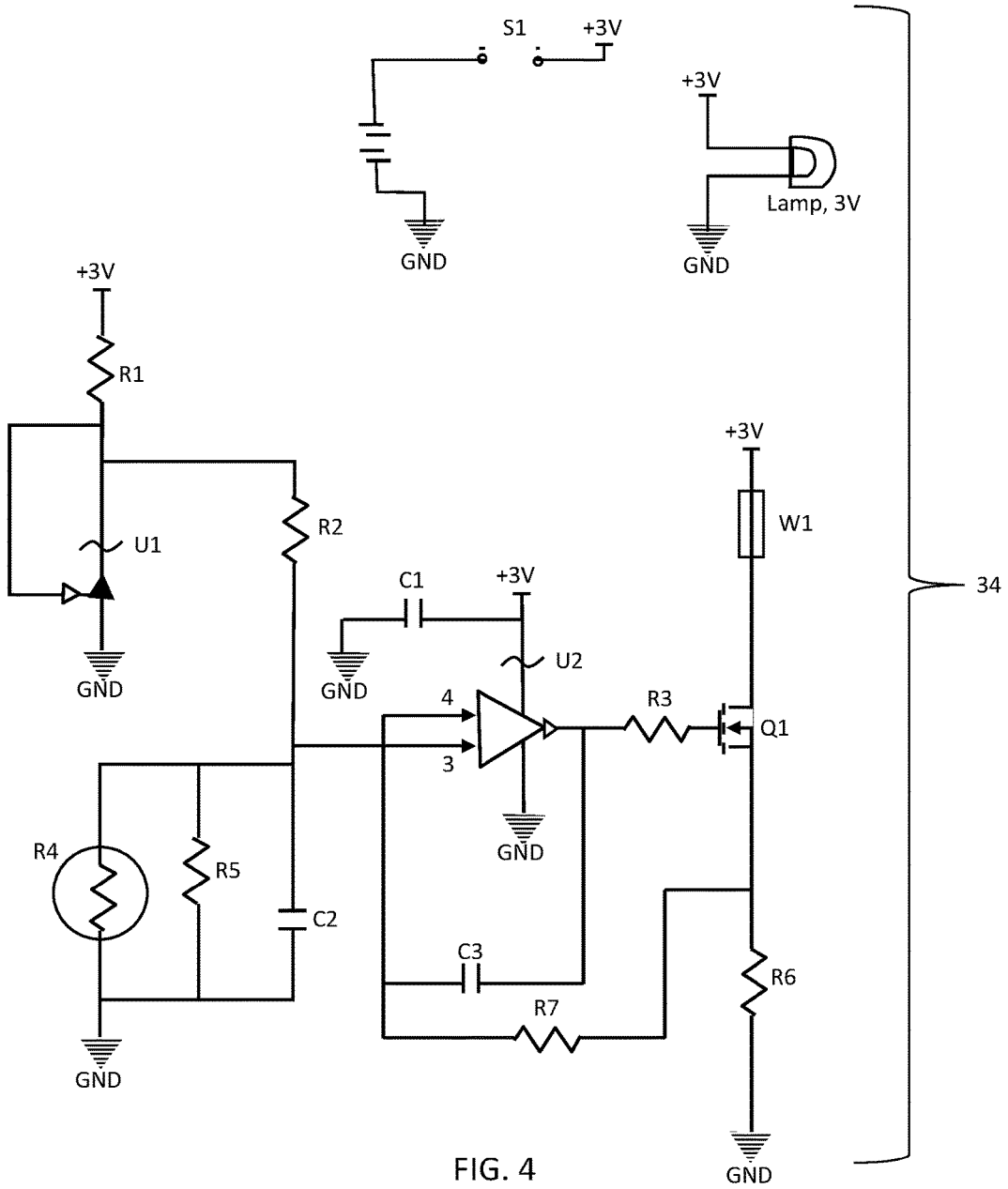
FIG. 4 is a schematic of the electronic control circuitry according to a preferred embodiment of the present invention in operation.

The heating band 30 can be made of, but not limited to, nichrome. The heating band 30 preferably has a diameter with a range of approximately 0.001 inches to approximately 0.200 inches. In one embodiment according to the present invention, the heating band 30 can further have a horizontally disposed (relative to the band posts 26, 28) cutting edge 31 to aid in cutting through the raised protrusions 14 of the blister packages 12. The device 10 utilizes a power element 32 (not shown) contained within the holder 20 for heating the heating band 30. In one embodiment according to the present invention, the power element 32 comprises an electronic control circuitry 34 shown in FIG. 4, contained within the holder 20, which controls the amount of current which heats the heating band 30 to the temperature required to make the material of said protrusions 14 malleable. The control circuitry maintains the temperature required to make the material of said protrusions 14 malleable, during varying ambient temperatures, by automatically adjusting the power current to heating band 30 to maintain the required temperature. However, the temperature is modulated such as to avoid overheating of the material, a condition which may result in combustion or outgassing/offgassing of harmful organic volatiles.

It is necessary to control the amount of current that the heating band 30 receives to make the device 10 safe for its users. Specifically, the heating band 30 has to reach a temperature high enough to transform the material of the raised protrusions 14 of the blister package 12 into a malleable state for removal of the product items 16. This is accomplished utilizing an electronic control circuitry 34 that supplies a current based on an ambient temperature and the required temperature to make the material of said protrusions 14 malleable (not shown). The amount of current that the heating band 30 receives is proportional to the ambient temperature with the amount of current necessary to heat the band increasing as the ambient temperature decreases.

For example, in one embodiment according to the present invention, and not meant as a limitation, if the ambient temperature is 50 degrees Fahrenheit, the heating band may require 1.5 amps of power in order to make the raised protrusions 14 malleable. However, if the ambient temperature is 100 degrees Fahrenheit, the heating band may only require 1 amp of power in order to effectively make the raised protrusions 14 malleable.

Lastly, the device has a power switch 36 for supplying a power source 38 via batteries (not shown) contained within holder 20 to the power element 32. The power source 38 can be a battery supplied power source or any other suitable power source 38 capable of supplying a current to heat the heating band 30. For example, and not meant as a limitation, the power source can be selected from the group consisting of an external AC power source, battery, rechargeable battery, fuel-cell means, and their combinations.

2. Operating of the Preferred Embodiment(s)

In operation, the present invention used in accordance with a preferred embodiment, as shown in FIGS. 1-2, the device 10 can be used for removing product items contained in a blister package 12 having raised protrusions 14 containing said product items 16 and a protective membrane 18 holding said items in said protrusions 14. This is accomplished by providing a device 10 having a holder 20 having a first end 22 and a second end 24 for holding said device 10, a first heating band post 26 affixed to said second end of said holder 20, a second heating band post 28 affixed to said second end of said holder 20, at least one heating band 30 extending between and affixed to said first heating band post 26 and said second heating band post 28, a power element 32 for heating said heating band, and a power switch 36 for supplying a power source 38 to said power element 32. A user then depresses the power switch 36 to an 'on' position, which applies a power source 38 to the power element 32. The power element 32 then heats the heating band 30 through a current to a certain temperature via control circuitry 34 based on an ambient temperature and the temperature required to make the material of said protrusions 14 malleable. Next, the user applies the heating band 30 of the device 10 to raised protrusions 14 of the blister package 12. Then, the user pushes the heating band 28 through the raised protrusions 14 of the blister package 12 until an opening is formed 40. The user continues to push the heating band 28 through the material until the opening 40 is of sufficient size for the removal of the product items 16 from the blister package 12.

The foregoing descriptions of specific embodiments of the present invention are presented for purposes of illustration and description only. They are not intended to be exhaustive or to limit the invention to the precise forms disclosed and, obviously, many modifications and variations are possible in light of the above teaching. The embodiments are chosen and described in order to best explain the principles of the invention and its practical application, to thereby enable others skilled in the art to best utilize the invention and the embodiments with various modifications as are suited to the particular use contemplated. It is intended that a scope of the invention be defined by the Claims appended hereto and to their equivalents. Therefore, the scope of the invention is to be limited only by the following claims.

What is claimed is:

1. A device for removing product items contained in a blister package, the device comprising:

a holder having a first end for holding said device opposite a second end, wherein said holder defines a longitudinal holder axis;

a positioning surface disposed at the second end of the holder, wherein the positioning surface defines a non-right angle with the holder axis;

first and second extension members extending below the positioning surface;

at least one heating band spaced from the positioning surface and extending between the first and second extension members;

a first heating band post extending from said second end of said holder, and a second heating band post extending from said second end of said holder, said second heating band post being spaced from said first heating band post, wherein the first heating band post includes an inner surface, wherein the second heating band post includes an inner surface, wherein a ledge extends between the first and second heating band posts, wherein the ledge includes a bottom surface and an upper surface, wherein the inner surface of the first heating band post, the inner surface of the second heating band post and the upper surface of the ledge define a window, wherein the first and second heating band posts are positioned between the second end of the holder and the ledge, and wherein the bottom surface of the ledge comprises the positioning surface;

a power element contained within said holder and in electrical communication with said at least one heating band; and a power switch in electrical communication with said power element.

2. The device of claim 1, wherein said heating band comprises a wire having a diameter having a range of approximately 0.001 inches to approximately 0.200 inches.

3. The device of claim 1, wherein said heating band extends perpendicular to the holder axis.

4. The device of claim 3, wherein said heating band extends parallel with said positioning surface.

5. The device of claim 1, wherein said power element is an electronic control circuitry which heats said heating band to a temperature based on a proportional offset from an ambient temperature.

6. The device of claim 1, wherein said first and second extension members extend parallel to said holder axis.

7. The device of claim 1, wherein an opening space is defined between said heating band, said positioning surface and said first and second extension members.

8. The device of claim 1, wherein said modulated and controlled elevated temperature is limited to temperatures for making blister pack protrusion materials malleable but without combusting or offgassing.

9. A device for opening blister packages, the device comprising:

a holder having first and second opposite ends, wherein the holder defines a longitudinal holder axis, a planar positioning surface disposed opposite the first end of the holder, wherein the positioning surface defines a non-right angle with the respect to the holder axis, first and second extension members extending below the positioning surface, wherein the first and second extension members are laterally spaced apart from one another and extend parallel to the holder axis, a heating band spaced from the positioning surface and extending between the first and second extension members, wherein the heating band extends parallel with respect to the positioning surface, and perpendicular with the respect to the holder axis, wherein an opening space is defined between the heating band, the positioning surface and the first and second extension members, a first heating band post extending from the second end of the holder, and a second heating band post extending from the second end of the holder, the second heating band post being spaced laterally from the first heating band post, wherein the first heating band post includes an inner surface, wherein the second heating band post includes an inner surface, wherein a ledge extends between the first and second heating band posts, wherein the ledge includes a bottom surface and an upper surface, wherein the inner surface of the first heating band post, the inner surface of the second heating band post and the upper surface of the ledge define a window, wherein the first and second heating band posts are positioned between the second end of the holder and the ledge, and wherein the bottom surface of the ledge comprises the positioning surface, a power element in electrical communication with the heating band for heating the heating band, and a power switch in electrical communication with the power element.

10. The device of claim 9, wherein the power element is an electronic control circuitry which heats the heating band to a temperature based on a proportional offset from an ambient temperature.

* * * * *